US010947943B2

(12) United States Patent
Haritani et al.

(10) Patent No.: US 10,947,943 B2
(45) Date of Patent: Mar. 16, 2021

(54) METHOD FOR MANUFACTURING FUEL INJECTION COMPONENT

(71) Applicant: DENSO CORPORATION, Kariya (JP)

(72) Inventors: Makoto Haritani, Tokyo (JP); Yuuki Tanaka, Nagoya (JP); Tomohiro Andoh, Nagoya (JP); Kazuyoshi Kimura, Tokyo (JP); Takahiro Miyazaki, Tokyo (JP); Keisuke Inoue, Nagoya (JP); Toshimasa Ito, Kariya (JP); Koji Morita, Kariya (JP); Tomomitsu Fukuoka, Kariya (JP); Tadashi Nishiwaki, Kariya (JP)

(73) Assignee: DENSO CORPORATION, Kariya (JP)

( * ) Notice: Subject to any disclaimer, the term of this patent is extended or adjusted under 35 U.S.C. 154(b) by 131 days.

(21) Appl. No.: 16/431,871

(22) Filed: Jun. 5, 2019

(65) Prior Publication Data

US 2019/0376479 A1 Dec. 12, 2019

(30) Foreign Application Priority Data

Jun. 7, 2018 (JP) ..... JP2018-109766

(51) Int. Cl.
*F02M 61/16* (2006.01)
*C22C 38/04* (2006.01)
(Continued)

(52) U.S. Cl.
CPC ..... *F02M 61/168* (2013.01); *C21D 6/004* (2013.01); *C21D 6/005* (2013.01); *C21D 6/008* (2013.01);
(Continued)

(58) Field of Classification Search
CPC ..... F02M 61/168; F02M 2200/80
See application file for complete search history.

(56) References Cited

U.S. PATENT DOCUMENTS 6,699,333 B1 * 3/2004 Dubois ..... C21D 6/004 148/233
8,354,613 B2 * 1/2013 Sugihashi ..... C22C 38/24 219/121.85
(Continued)

OTHER PUBLICATIONS

Yukitaka Murakami, "Metal Fatigue:Effects of Small Defects and Nonmetallic Inclusions", Elsevier 2002, 390 pages.
(Continued)

*Primary Examiner* — Jason L Vaughan
(74) *Attorney, Agent, or Firm* — Nixon & Vanderhye PC

(57) ABSTRACT

A workpiece for a fuel injection component is made of a steel having compositions, by mass %, of C: 0.08 to 0.16%, Si: 0.10 to 0.30%, Mn: 1.00 to 2.00%, S: 0.005 to 0.030%, Cu: 0.01 to 0.30%, Ni: 0.40 to 1.50%, Cr: 0.50 to 1.50%, Mo: 0.30 to 0.70%, V: 0.10 to 0.40%, s-Al: 0.001 to 0.100%, and Fe and unavoidable impurities as remaining components. After heating the workpiece to a temperature of 950° C. or more and 1350° C. or less, the workpiece is subjected to a hot forging, and thereafter cooled at an average cooling rate of 0.1° C./sec. or more in a temperature range from 800° C. to 500° C., and at the average cooling rate of 0.02° C./sec. or more and 10° C./sec. or less in the subsequent temperature range from 500° C. to 300° C. to set an area ratio of a bainite structure after hot forging to 85% or more.

7 Claims, 2 Drawing Sheets

(51) Int. Cl.

| | |
|---|---|
| ***C22C 38/10*** | (2006.01) |
| ***C22C 38/16*** | (2006.01) |
| ***C22C 38/06*** | (2006.01) |
| ***C21D 6/00*** | (2006.01) |
| ***C21D 9/00*** | (2006.01) |

(52) U.S. Cl.

CPC ..... *C21D 9/0068* (2013.01); *C22C 38/04* (2013.01); *C22C 38/06* (2013.01); *C22C 38/105* (2013.01); *C22C 38/16* (2013.01); *F02M 2200/80* (2013.01)

(56) References Cited

U.S. PATENT DOCUMENTS

| | | | | |
|---|---|---|---|---|
| 10,308,994 | B2 * | 6/2019 | Kawabata ..... | C21D 7/02 |
| 2013/0186529 | A1 | 7/2013 | Teramoto et al. | |
| 2015/0034049 | A1 | 2/2015 | Matsui et al. | |

OTHER PUBLICATIONS

JSA—JIS G 1257-10-2 Iron and steel—Atomic absorption spectrometric method —Part 10: Determination of aluminum—Section 2: Determination of acid-soluble aluminium, Nov. 20, 2013, JSA, 44 pages.

* cited by examiner

METHOD FOR MANUFACTURING FUEL INJECTION COMPONENT

CROSS REFERENCE TO RELATED APPLICATION

The present application claims the benefit of priority from Japanese Patent Application No. 2018-109766 filed on Jun. 7, 2018. The entire disclosure of the above application is incorporated herein by reference.

TECHNICAL FIELD

The present disclosure relates to a method for manufacturing a fuel injection component.

BACKGROUND

Conventionally, heat treated steels that are quenched and tempered (thermal refining treatment) after hot working such as hot forging have been used for automotive components, mechanical structural components, and the like requiring strength and toughness.

SUMMARY

According to an aspect of the present disclosure, a method for manufacturing a fuel injection component includes hot forging on a steel workpiece and an additional heat treatment on the steel workpiece.

BRIEF DESCRIPTION OF THE DRAWINGS

The above and other objects, features and advantages of the present invention will become more apparent from the following detailed description made with reference to the accompanying drawings. In the drawings.

DETAILED DESCRIPTION

Figure 1A:
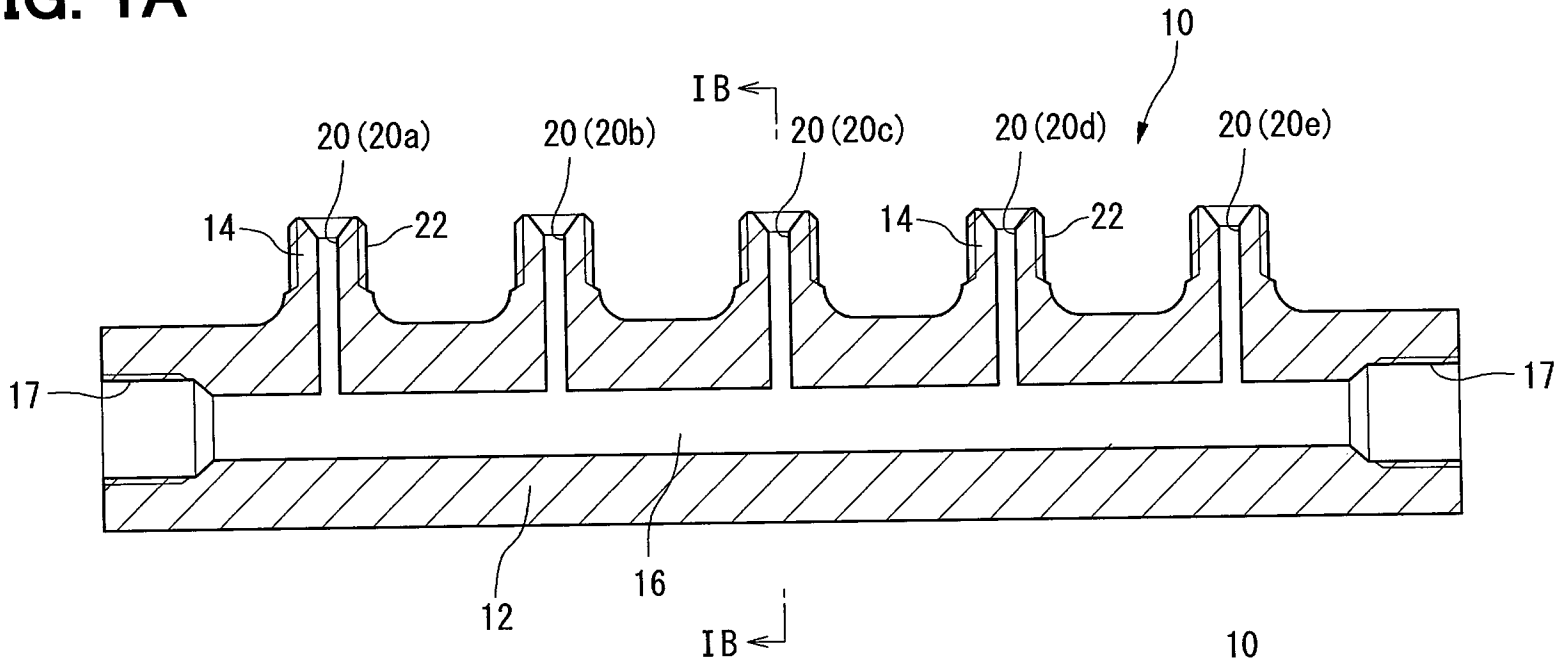
FIG. 1A is a vertical cross-sectional view showing a common rail to which a manufacturing process of the present embodiment is applied.

To begin with, investigations accompanied with the present disclosure will be described.

Generally, heat treated steels are excellent in strength and toughness. Nevertheless, heat treated steels generally incur heat treatment costs for quenching and tempering treatment (thermal refining treatment) after hot working. Consequently, components manufactured of heat treated steels are generally high in manufacturing cost. Further, in the heat treated steel, a large heat treatment distortion may arise due to martensitic transformation therein. Consequently, additional machining for correcting the shape and the dimension of the workpiece could be required after the heat treatment, resulting in decrease in a production yield. Moreover, the machining is presumably performed on the workpiece under a hard martensite state. Therefore, machinability (processability) under the state may be low, a time required for manufacturing the component may be long, and the manufacturing cost could be high.

For that reason, it is conceivable to employ a non-heat treated steel as a heat treated steel substitute material to mechanical structural components and the like as a material that can satisfy cost reduction. The non-heat treated steel develops a required hardness while being kept in a hot worked state and exhibits a desired strength even without the quenching and tempering treatment after hot working.

More specifically, it is conceivable to employ, for example, a ferrite-pearlite type non-heat treated steel in fuel injection components such as a common rail. The common rail is used in a fuel injection system for directly injecting a high-pressure fuel into a fuel chamber of each cylinder and to which a high internal pressure is repeatedly applied.

A common rail made of such a ferrite-pearlite type non-heat treated steel may be able to cope with a fuel pressure (common rail pressure) up to 250 MPa. However, even though, it could be difficult to develop a high strength (tensile strength and yield strength) corresponding to a fuel pressure of 270 to 300 MPa class, which will become a mainstream in the future. In addition, a risk of brittle fracture would occur when an operating maximum pressure or an abnormal high pressure is applied.

It is further conceivable to use, as the non-heat treated steel, a bainite non-heat treated steel which is to exhibit a bainite structure as it is hot worked. However, although the bainite non-heat treated steel can be made higher in strength than the ferrite-pearlite non-heat treated steel, the toughness may be still insufficient, and an improvement in the internal pressure fatigue characteristics could be required for the application to the fuel injection component to which the fuel pressure exceeding 250 MPa is applied.

It is further conceivable to control a cooling rate from a hot forging finish temperature to a specific temperature to produce a steel component exhibiting a high fatigue strength and high toughness mechanical structure. Specifically, a cooling rate from a hot forging finish temperature to 300° C. may be controlled under a condition to achieve an area ratio of the bainite structure which is set to 95% or more and a width of a bainite lath is set to 5 μm or less.

In order to achieve a higher internal pressure fatigue strength, various temperature ranges and various cooling rate ranges for controlling a cooling rate could be conceivable. In addition, various measures for increasing toughness and fatigue strength may be conceivable such as inclusion of additive such as Ni to an alloy composition.

According to an example of the present disclosure, a method is for manufacturing a fuel injection component by processing a workpiece into a predetermined shape. The workpiece is made of a steel having compositions, by mass %, of C: 0.08 to 0.16%, Si: 0.10 to 0.30%, Mn: 1.00 to 2.00%, S: 0.005 to 0.030%, Cu: 0.01 to 0.30%, Ni: 0.40 to 1.50%, Cr: 0.50 to 1.50%, Mo: 0.30 to 0.70%, V: 0.10 to 0.40%, s-Al: 0.001 to 0.100%, and Fe and unavoidable impurities as remaining components. The method comprises subjecting the workpiece to hot forging after heating the workpiece to a temperature of 950° C. or more and 1350° C. or less. The method further comprises first cooling the workpiece, after the hot forging, at an average cooling rate of 0.1° C./sec. or more in a temperature range from 800° C. to 500° C. The method further comprises second cooling the workpiece, after the first cooling, at an average cooling rate of 0.02° C./sec. or more and 10° C./sec. or less in a subsequent temperature range from 500° C. to 300° C. to set an area ratio of a bainite structure after hot forging to 85% or more. The above-described heating temperature represents a temperature on the surface of the workpiece. The average cooling rate represents an average cooling rate on the surface of the workpiece.

According to a further example, the steel further contains one or two of Ti: ≤0.100% and Nb: ≤0.100% by mass %.

According to a further example, a maximum diameter √areamax of non-metallic inclusions estimated by an extreme value statistical method in the workpiece after the hot forging is 300 μm or less. The non-metallic inclusions represent inclusions residing in steel and being a sulfide containing MnS as a main component, an oxizide containing Al2O2 as a main component, and/or a nitride containing TiN as a main component.

According to a further example, the method further comprises performing, after the hot forging, an aging treatment in a temperature range of 550° C. to 700° C.

According to a further example, the method further comprises performing an autofrettaging process on the workpiece in which a fuel flow channel is formed.

As described above, the example enhances the toughness by minimizing the cementite precipitated in the bainite structure by using a steel material (workpiece) having a high Ni content and a low C content by controlling the average cooling rate after hot forging, thereby enhancing the internal pressure fatigue strength of the fuel injection component to be manufactured.

In the bainite non-heat treated steel, Ni addition could be particularly effective in increasing the resistance, that is, the fracture toughness value, against the crack propagation in the presence of a crack when a force is applied from the outside. For that reason, according to the present disclosure, Ni has a high content of 0.40% or more.

In addition, according to the example, the average cooling rate after hot forging, specifically, the average cooling rate in the temperature range from 500° C. to 300° C. is controlled to be 0.02° C./sec. or more and 10° C./sec. or less along with the reduction in C. As a result, the toughness is enhanced by minimizing cementite, which is generated in the cooling process after hot forging and can be a starting point for crack generation.

According to the example, the structure after the hot forging is substantially a bainite single phase structure. More specifically, the area ratio of the bainite structure is set to 85% or more. This is because, when the ferrite structure is mixed in the structure, not only the aging hardening characteristics are lowered, but also the load bearing ratio and the durability ratio are lowered, as a result of which a concern arises that the fatigue strength is lowered. For that reason, according to the present disclosure, the average cooling rate in the temperature range from 800° C. to 500° C. is controlled to be 0.1° C./second or more.

According to the example, one or two kinds of Ti and Nb can be contained in a predetermined content as necessary.

According to the example, the maximum diameter $\sqrt{area}_{max}$ of the non-metallic inclusions estimated by an extreme value statistical method in the workpiece which has been subjected to hot forging may be set to 300 μm or less. The internal pressure fatigue strength of the fuel injection component can be further enhanced by a reduction in the generation of coarse non-metallic inclusions that can be the starting point of crack generation.

In addition, according to the example, after the structure kept to be hot forged is substantially put into a bainite single phase structure, the hardness can be increased by subsequent aging treatment to achieve a high strength. At this time, in order to miniaturize Mo carbide, V carbide, or the like precipitated in steel, aging treatment in a temperature range of 550° C. to 700° C. may be performed.

As a measure for increasing the internal pressure fatigue strength of the fuel injection component such as a common rail, an autofrettaging process has been known in which an internal pressure is applied to a fuel flow channel inside the fuel injection component to apply a residual stress. Also, in the manufacturing method according to the present disclosure, the internal pressure fatigue strength can be further increased by subjecting the workpiece in which the fuel flow channel for circulating or storing the high-pressure fuel is defined to the autofrettaging process.

Subsequently, reasons for limiting each chemical component and the production conditions in the present disclosure will be described in detail below.

C: 0.08 to 0.16%

C is an element necessary for securing the strength, and carbides of Mo and V are precipitated by the aging hardening treatment to increase the strength of steel. For the action of C, C of 0.08% or more is required, and if C is less than 0.08%, the required hardness and strength cannot be ensured. On the other hand, if the content of C exceeds 0.16%, the amount of cementite increases and the toughness deteriorates, so that an upper limit of the C content is set to 0.16%.

Si: 0.10 to 0.30%

Si is added as a deoxidizer during melting of steel and to improve strength.

For the action of Si, there is a need to contain Si of 0.10% or more. On the other hand, since Si of excessive content exceeding 0.30% causes a decrease in fatigue strength, an upper limit of the Si content is set to 0.30%.

Mn: 1.00 to 2.00%

There is a need to contain Mn of 1.00% or more in order to secure hardenability (secure bainite structure), improve strength, and improve machinability (MnS crystallization). However, since Mn of an excessive content exceeding 2.00% causes martensite formation, an upper limit of the Nn content is set to 2.00%.

S: 0.005 to 0.030%

S needs to be contained in an amount of 0.005% or more in order to secure machinability. However, since S of an excessive content exceeding 0.030% causes deterioration of the productivity, an upper limit of the S content is set to 0.030%.

Cu: 0.01 to 0.30%

Cu is contained to secure hardenability (to secure bainite structure) and to improve strength. For the action of Cu, there is a need to contain Cu of 0.01% or more. However, since Cu of an excessive content exceeding 0.30% causes an increase in cost and deteriorates the productivity, an upper limit of the Cu content is set to 0.30%.

Ni: 0.40 to 1.50%

Ni is an indispensable component in the present disclosure for the purpose of securing toughness (fracture toughness), and Ni is contained at 0.40% or more for the action of Ni. However, since Ni of an excessive content exceeding 1.50% causes an increase in cost, an upper limit of the Ni content is set to 1.50%.

Cr: 0.50 to 1.50%

Cr is contained in order to secure hardenability (to secure bainite structure) and to improve strength. For the function of Cr, there is a need to contain Cr of 0.50% or more. However, since Ni of an excessive content exceeding 1.50% causes an increase in cost, an upper limit of the Ni content is set to 1.50%.

Mo: 0.30 to 0.70%

Mo is contained because Mo carbide is precipitated by aging hardening treatment to obtain high strength. Mo is contained at 0.30% or more for the function of Mo. However, since Mo of an excessive content exceeding 0.70% causes an increase in cost, an upper limit of the Mo content is set to 0.70%.

V: 0.10 to 0.40%

As with Mo, V causes V carbide to be precipitated by aging hardening treatment to increase the strength of steel. There is a need to contain V of 0.10% or more because of the action of V. However, since V of an excessive content exceeding 0.40% causes an increase in cost, an upper limit of the V content is set to 0.40%.

s-Al: 0.001 to 0.100%

The s-Al is used for deoxidation during dissolution and contained in at least 0.001% or more. In addition, the effect of grain refinement by precipitation of AlN leads to an improvement in toughness. However, since the excessive precipitation of AlN leads to the deterioration of machinability, an upper limit of the s-Al content is set to 0.100%.

s-Al represents acid-soluble aluminum and is quantified by a method disclosed in Appendix 15 to JIS G 1257 (1994). The content of JIS G 1257 (1994) is incorporated herein by reference.

Forging heating temperature: 950 to 1350° C.

In order to obtain a bainite single phase structure, there is a need to heat the workpiece to 950° C. or more in hot forging. This is because when the forging heating temperature is less than 950° C., ferrite is easily generated in the structure after forging. However, in consideration of the fact that excessive heating causes damage to a heat treatment furnace and an increase in energy cost, the forging heating temperature is set to 1350° C. or less.

Average cooling rate from 800° C. to 500° C.: 0.1° C./sec. or higher

In order to avoid ferrite-pearlite transformation from occurring during cooling after hot forging, the average cooling rate from 800° C. to 500° C. shall be set to 0.1° C./sec. or more. More preferably, the average cooling rate is set to 0.2° C./sec. or more.

On the other hand, an upper limit of the average cooling rate is not particularly limited, but in consideration of the facility capacity and continuity with subsequent cooling of 500° C. or less, it is preferable to perform cooling of 10° C./second or less.

Average cooling rate from 500° C. to 300° C.: 0.02 to 10° C./sec

If the average cooling rate from 500° C. to 300° C. is excessively slow, coarse cementite precipitates in the bainite structure and the toughness decreases. For that reason, the average cooling rate from 500° C. to 300° C. is set to 0.02° C./sec. or more. On the other hand, when the average cooling rate from 500° C. to 300° C. is excessively high, martensitic transformation occurs and the hardness kept to be forged becomes excessively high, so that there is a need to set the average cooling rate to 10° C./sec. or less. A more preferable range of the average cooling rate is set to 0.4 to 5° C./sec.

Area Ratio of Bainite Structure: 85% or More

When 15% or more of a structure other than bainite is mixed in the bainite structure, not only the aging hardening characteristics are deteriorated, but also the load bearing ratio and the durability ratio are deteriorated, which may lead to the deterioration of the fatigue strength. For that reason, the area ratio of the bainite structure is set to 85% or more. More preferably, the area ratio is 90% or more.

Ti: ≤0.100%

Nb: ≤0.100%

Ti precipitates Ti carbide by the aging hardening treatment, and contributes to further increase in strength. In addition, since MnS miniaturization by TiN precipitation contributes to an improvement in processability, Ti can be contained as necessary. However, since Ti of an excessive content exceeding 0.100% lowers toughness, an upper limit of the Ti content is set to 0.100%. When Ti is contained, the Ti content is preferably 0.005% or more.

Nb precipitates Nb carbide by aging hardening treatment and contributes to further increase in strength. However, since Nb of an excessive content exceeding 0.100% lowers toughness, an upper limit of the Nb content is set to 0.100%. When Nb is contained, the Nb content is preferably 0.005% or more.

Only one of Ti and Nb may be contained, but both of Ti and Nb may be contained.

Maximum diameter $\sqrt{area}_{max}$ of non-metallic inclusions: not more than 300 μm Non-metallic inclusions present in steels are effective in inhibiting austenite grain growth during hot forging, but excessively large inclusions become a starting point of fatigue fracture and reduce fatigue strength, so that an upper limit of the maximum diameter $\sqrt{area}_{max}$ of the non-metallic inclusions is set to 300 μm. The maximum diameter $\sqrt{area}_{max}$ can be obtained based on an extreme value statistical method disclosed in Non Patent Literature 1 below. The content of Non Patent Literature 1 is incorporated herein by reference.

[Non patent Document 1] Keiji Murakami: Effects of Metal Fatigue Micro Defects and Intermediates (1993), [YOKENDO]

Aging Treatment Temperature: 550° C. to 700° C.

In the present disclosure, fine carbides can be precipitated in steel by performing aging treatment after hot forging, and the strength can be increased. However, when the aging treatment temperature is excessively low, the precipitation amount of carbide is small and a sufficient effect cannot be obtained, so that the aging treatment temperature is preferably set to 550° C. or more.

On the other hand, as the aging treatment temperature is higher, the precipitated carbide becomes coarser. In addition, since the bainite is reversely transformed into austenite at the time of the aging hardening treatment, and a part of the austenite is martensitized at the time of subsequent cooling, and martensite phase is generated around a residual austenite in an island shape to remarkably lower the toughness, it is preferable that the aging treatment temperature is set to 700° C. or less.

Figure 1B:
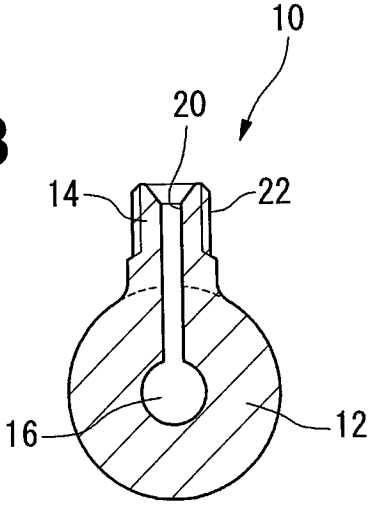
FIG. 1B is a horizontal cross-sectional view showing the common rail.

As follows, a manufacturing method according to one embodiment of the present disclosure will be described. FIGS. 1A and 1B show a common rail 10 as a fuel injection component. The common rail 10 is a component for accumulating a high-pressure fuel to be supplied to an injector for injecting the fuel into a cylinder of an internal combustion engine such as a diesel engine. As shown in the FIGS. 1A and 1B, the common rail 10 has a body portion 12 extending linearly in one direction, and multiple connection cylinder portions 14 provided so as to project from a side surface of the body portion 12. A main hole 16 used as a fuel pressure accumulating chamber is defined inside the body portion 12 in a longitudinal direction of the body portion 12. On the other hand, a small hole 20 is defined inside each of the connection cylinder portions 14 so that one end of the connecting cylinder portion 14 communicates with the main hole 16. The main hole 16 and the small holes 20 define a fuel flow channel for circulating or storing the high-pressure fuel.

Two internal threaded portions 17 are formed at both ends of the body portion 12, and male threaded portions 22 are formed on outer peripheral surfaces of tips of the respective connection cylinder portions 14, and the female threaded portions 17 and the external threaded portions 22 can be fastened and fixed to respective mating member.

The common rail 10 described above can be manufactured by performing steps of hot forging, machining, aging, and autofrettaging process in stated order, for example, with the use of a workpiece having a predetermined chemical composition. As the workpiece to be used for the hot forging, a billet obtained by ingot lump rolling, a billet obtained by continuous casting material lump rolling, a bar steel obtained by hot rolling or hot forging those billets, or the like can be used.

Figure 2:
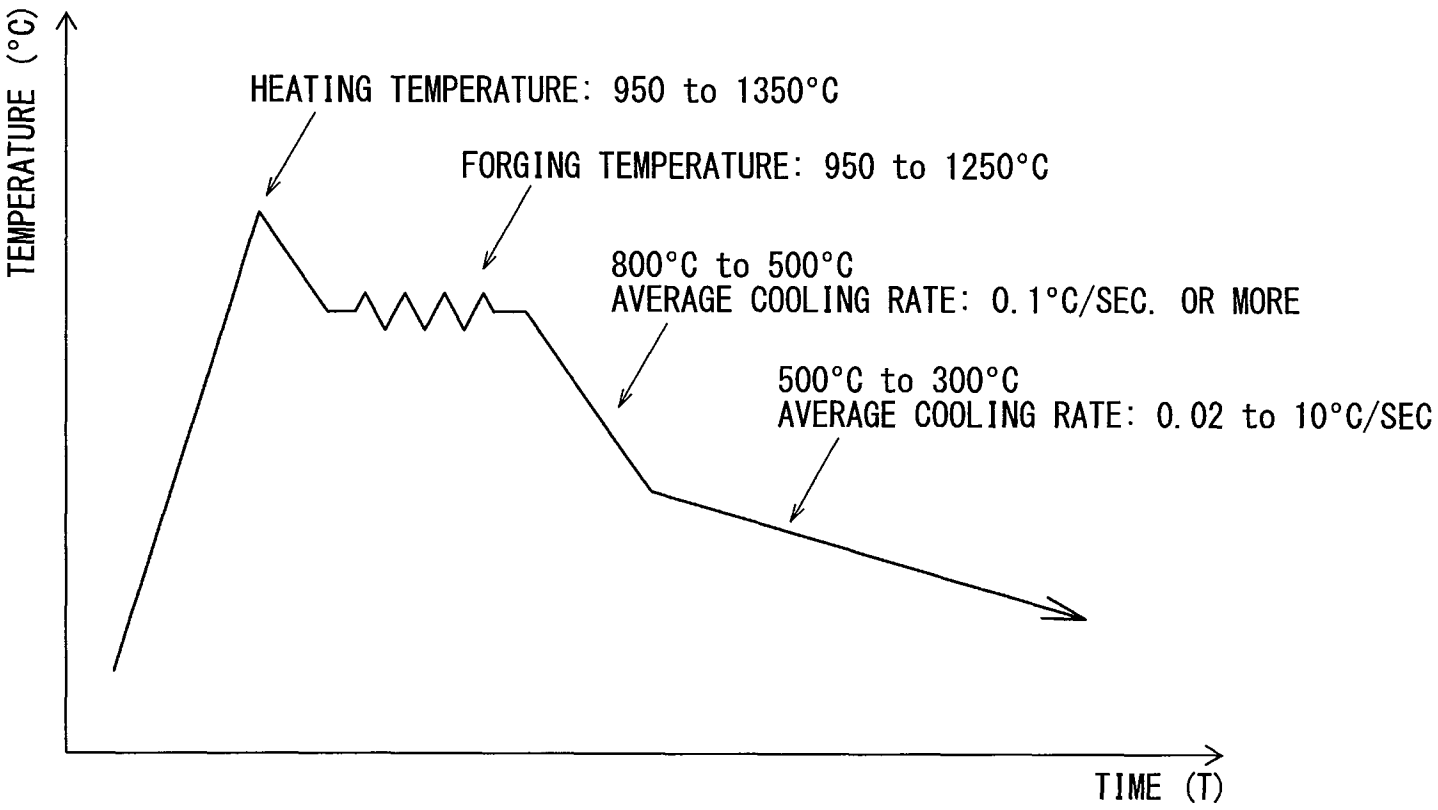
FIG. 2 is an illustrative view showing hot forging in the manufacturing method according to the present embodiment.

In hot forging, as shown in FIG. 2, the workpiece is first heated to a predetermined forging heating temperature (950 to 1350° C.). Then, hot forging is performed on the heated workpiece at a workpiece temperature of 950 to 1250° C. with the use of a mold so as to obtain an external shape such as the common rail 10.

After the hot forging has been completed, the workpiece is cooled to approximately room temperature. In this example, the workpiece is cooled in a temperature range from 800° C. to 500° C. at an average cooling rate of 0.1° C./sec. or more, and in a subsequent temperature range from 500° C. to 300° C. at 0.02° C./sec. or more and 10° C./sec. or less, and the steel structure after hot forging is put into a bainite single phase structure. In this example, the average cooling rate is an average cooling rate at a surface of the workpiece.

Cooling is carried out by cooling in the atmosphere or by impingement air cooling using a fan. Cooling conditions for satisfying the above specification of the average cooling rate vary depending on the ambient temperature, the shape and size of the workpiece, and the like, and therefore, it is desirable to experimentally determine the cooling conditions in advance.

The workpiece, which has been formed into the substantially outer shape of the common rail by hot forging, is then machined, such as by cutting, to form the internal fuel flow channels 16 and 20, as well as the female threaded portions 17, the male threaded portions 22, and the like. In order to perform the machining satisfactorily, it is desirable to set the hardness of the workpiece after the hot forging to 33 HRC or less.

Next, aging treatment is performed at a center temperature of the workpiece of 550° C. to 680° C. for 0.5 to 10 hours to obtain a desired hardness.

Next, an autofrettaging process is performed on the workpiece in which the fuel flow channels 16 and 20 for circulating or storing the high-pressure fuel are provided. More specifically, in order to seal the fuel flow channels 16 and 20, one end portion of each of the connection cylinder portion 14 and the body portion 12 is sealed, a pressure application medium (hydraulic oil) is introduced into the main hole 16 from the other end side of the body portion 12, and the introduced pressure application medium is pressurized. At this time, a pressure of the pressure application medium is set to a pressure (for example, about 500 MPa to 1000 MPa) for plastically deforming the inside of the body portion 12 and elastically deforming the outside of the body portion 12. As a result, a residual compressive stress can be applied to the inside of the body portion 12, and a pressure resistant fatigue strength of the body portion 12 can be enhanced.

The common rail 10 can be manufactured through the above processes. In some cases, the aging process and the autofrettaging process can be omitted as appropriate, for example, the aging treatment is omitted by increasing the hardness of the hot working as it is. The machining process can be implemented separately before and after the autofrettaging process, or an exterior treatment such as plating can be finally added.

150 kg of steel of steel types A to M (13 types) having chemical compositions shown in Table 1 below is melted in a vacuum induction melting furnace, and forged to a round bar having a diameter of φ60 mm at 1250° C. Thereafter, the φ60 mm round bar is heated to 950 or more and 1350° C. or less in accordance with the manufacturing conditions shown in Table 2, subjected to a hot forging process in which the round bar is hot forged into a shape corresponding to the common rail, and then cooled from a temperature at an end of forging to about room temperature to obtain a hot forged material. Then, inclusion evaluation, microstructure observation, and hardness test are performed using the hot forged material. Further machining is performed to produce a common rail, and the internal pressure fatigue strength and the burst fracture strength are evaluated.

TABLE 1

| | Chemical composition (mass %, balance Fe) | | | | | | | | | | |
|---|---|---|---|---|---|---|---|---|---|---|---|
| Steel type | C | Si | Mn | S | Cu | Ni | Cr | Mo | V | s-Al | Other |
| A | 0.13 | 0.21 | 1.40 | 0.022 | 0.10 | 0.61 | 1.00 | 0.60 | 0.33 | 0.021 | |
| B | 0.09 | 0.20 | 1.30 | 0.029 | 0.09 | 0.60 | 1.01 | 0.70 | 0.21 | 0.023 | 0.010Ti, 0.01Nb |
| C | 0.11 | 0.11 | 1.78 | 0.030 | 0.09 | 0.41 | 1.01 | 0.31 | 0.39 | 0.018 | 0.096Ti |
| D | 0.15 | 0.21 | 1.40 | 0.012 | 0.10 | 0.61 | 1.00 | 0.70 | 0.11 | 0.025 | 0.090Ti |
| E | 0.13 | 0.30 | 1.43 | 0.005 | 0.09 | 0.60 | 1.26 | 0.31 | 0.33 | 0.025 | |
| F | 0.15 | 0.20 | 1.00 | 0.022 | 0.09 | 0.41 | 1.48 | 0.60 | 0.21 | 0.021 | 0.01Nb |
| G | 0.13 | 0.30 | 2.00 | 0.005 | 0.09 | 0.98 | 0.75 | 0.31 | 0.21 | 0.020 | |
| H | 0.15 | 0.24 | 1.00 | 0.005 | 0.09 | 0.98 | 1.10 | 0.60 | 0.33 | 0.025 | |
| I | 0.12 | 0.30 | 1.90 | 0.022 | 0.09 | 0.60 | 0.50 | 0.60 | 0.30 | 0.038 | |
| J | 0.15 | 0.24 | 1.90 | 0.012 | 0.28 | 0.87 | 1.00 | 0.60 | 0.20 | 0.021 | |
| K | 0.12 | 0.21 | 1.40 | 0.012 | 0.10 | 0.55 | 1.00 | 0.60 | 0.33 | 0.033 | |
| L | 0.10 | 0.20 | 1.50 | 0.012 | 0.10 | 0.61 | 1.20 | 0.60 | 0.21 | 0.036 | |
| M | 0.10 | 0.21 | 1.20 | 0.012 | 0.10 | 0.51 | 0.52 | 0.44 | 0.30 | 0.031 | |

TABLE 2

| | | Steel type | Manufacture conditions: Heating Temperature (° C.) | First average cooling rate (° C./sec.) | Second average cooling rate (° C./sec.) | Inclusion size (μm) | Aging temperature (° C.) | AF processing | Evaluation: Microstructure (bainite ratio) | Pre-aging hardness (HRC) | Hardness after aging (HRC) | Cure amount (HRC) | Internal pressure fatigue strength | Burst fracture strength |
|---|---|---|---|---|---|---|---|---|---|---|---|---|---|---|
| Example | 1 | A | 1200 | 1.8 | 0.6 | 28 | 625 | — | ○ (100%) | 30.9 | 36.1 | 5.2 | ○ | ○ |
| | 2 | A | 1300 | 2.0 | 0.9 | 28 | 625 | — | ○ (100%) | 31.4 | 35.8 | 4.4 | ○ | ○ |
| | 3 | A | 960 | 1.9 | 0.9 | 28 | 625 | — | ○ (100%) | 30.1 | 34.7 | 4.6 | ○ | ○ |
| | 4 | A | 1200 | 0.6 | 0.4 | 28 | 625 | — | ○ (100%) | 29.9 | 35.0 | 5.1 | ○ | ○ |
| | 5 | A | 1200 | 1.8 | 0.02 | 28 | 625 | — | ○ (100%) | 30.3 | 36.0 | 5.7 | ○ | ○ |
| | 6 | B | 1200 | 2.1 | 1.0 | 32 | 625 | — | ○ (100%) | 28.5 | 33.5 | 5.0 | ○ | ○ |
| | 7 | C | 1200 | 1.8 | 0.9 | 34 | 625 | — | ○ (100%) | 29.7 | 35.0 | 5.3 | ○ | ○ |
| | 8 | D | 1200 | 2.0 | 0.6 | 30 | 625 | — | ○ (100%) | 30.0 | 33.9 | 3.9 | ○ | ○ |
| | 9 | E | 1200 | 2.0 | 0.9 | 24 | 625 | — | ○ (100%) | 31.0 | 34.8 | 3.8 | ○ | ○ |
| | 10 | F | 1200 | 1.9 | 0.7 | 21 | 625 | — | ○ (100%) | 31.5 | 34.4 | 2.9 | ○ | ○ |
| | 11 | G | 1200 | 1.9 | 0.6 | 22 | 625 | — | ○ (100%) | 30.9 | 35.0 | 4.1 | ○ | ○ |
| | 12 | H | 1200 | 2.2 | 1.0 | 21 | 625 | — | ○ (100%) | 30.9 | 37.0 | 6.1 | ○ | ○ |
| | 13 | I | 1200 | 2.0 | 0.8 | 33 | 625 | — | ○ (100%) | 30.4 | 35.6 | 5.2 | ○ | ○ |
| | 14 | K | 1200 | 3.1 | 1.4 | 101 | 625 | — | ○ (100%) | 30.8 | 36.0 | 5.2 | ○ | ○ |
| | 15 | L | 1200 | 1.9 | 1.0 | 331 | 625 | — | ○ (100%) | 31.1 | 34.0 | 2.9 | ○ | ○ |
| | 16 | A | 1200 | 4.1 | 2.5 | 28 | 530 | — | ○ (100%) | 31.2 | 33.5 | 2.3 | ○ | ○ |
| | 17 | A | 1200 | 4.0 | 2.4 | 28 | 550 | — | ○ (100%) | 30.4 | 34.5 | 4.1 | ○ | ○ |
| | 18 | A | 1200 | 4.2 | 2.9 | 28 | 680 | — | ○ (100%) | 30.3 | 34.6 | 4.3 | ○ | ○ |
| | 19 | A | 1200 | 4.0 | 2.5 | 28 | 700 | — | ○ (100%) | 31.3 | 33.0 | 1.7 | ○ | ○ |
| | 20 | J | 1200 | 4.2 | 2.3 | 33 | — | — | ○ (100%) | 35.5 | — | — | ○ | ○ |
| | 21 | A | 1200 | 2.0 | 0.8 | 28 | 625 | ○ | ○ (100%) | 31.2 | 36.0 | 4.9 | ○ | ○ |
| Comp. example | 1 | A | 930 | 0.4 | 0.4 | 28 | 625 | — | xF (80%) | 27.1 | 32.4 | 5.3 | x | x |
| | 2 | M | 1200 | 0.08 | 0.4 | 28 | 625 | — | xF (75%) | 22.5 | 26.0 | 3.5 | x | x |
| | 3 | A | 1200 | 2.0 | 0.015 | 28 | 625 | — | ○ (100%) | 29.5 | 34.5 | 5.0 | x | x |

In the cooling treatment, the surface temperature of the workpiece is measured by a radiation thermometer, and the average cooling rate from 800° C. to 500° C. is determined as the first average cooling rate, and the average cooling rate from 500° C. to 300° C. is determined as the second average cooling rate, and the results are shown in Table 2.

<Inclusion Evaluation>

The maximum diameter $\sqrt{area_{max}}$ of the non-metallic inclusions in the 3000 $mm^2$ estimated by the extreme value statistical method is obtained by observing a cross section of the hot forged material parallel to a longitudinal direction with an optical microscope.

The maximum diameter $\sqrt{area_{max}}$ of the non-metallic inclusions can be obtained as follows based on the measuring method disclosed in Non Patent Literature 1 described above.

[1] After polishing a cross section of the hot forged material parallel to the longitudinal direction, a test reference area $S_0$ ($mm^2$) is determined with the polished surface as a test area.

[2] A non-metallic inclusion that occupies a maximum area in the $S_0$ is selected, and a square root $\sqrt{area_{max}}$ (μm) of the area of the non-metallic inclusion is measured.

[3] The measurement is repeated n times to avoid duplication of the inspection part.

[4] The measured $\sqrt{area_{max}}$ is rearranged in ascending order, and each is set to $\sqrt{area_{max,j}}$ (j=1 to n).

[5] For each of j, the following normalized variable $y_j$ is calculated.

$$y_j=-\ln[-\ln\{j/(n+1)\}]$$

[6] In the coordinates of an extreme value statistical paper, $\sqrt{area_{max}}$ is taken on the abscissa, and normalized variables y are taken on the ordinate, and j=1 to n are plotted, and an approximate straight line is obtained by the least squares method.

[7] If the area to be evaluated is S ($mm^2$) and a recursive period is $T=(S+S_0)/S_0$, the value of y is obtained from Expression (1) below, and the $\sqrt{area_{max}}$ in the value of y is calculated with the use of the approximate curve described above, the maximum diameter of the non-metallic inclusion in the area S to be evaluated is $\sqrt{area_{max}}$.

$$y=-\ln[-\ln\{(T-1)/T\}] \quad \text{Expression (1)}$$

In this example, the tests with the test reference area $S_0$=100 $mm^2$ and the test number n=30 times are performed to determine the maximum diameter $\sqrt{area_{max}}$ of the non-metallic inclusions in the 3000 $mm^2$, and the results are shown in Table 2.

<Hardness Test>

The hardness test is performed on a load of a 150 kgf diamond conical indenter with a Rockwell hardness tester according to JIS Z 2245. The measurement is carried out at a position having a radius of ½ of the hot forged material.

<Microstructure Observation>

For the observation of the microstructure, a longitudinal cross section of the hot forged material is observed by an optical microscope (magnification: 400×) after nital corrosion, and the bainite ratio is measured. As for the bainite ratio, the evaluation of O is made when the area ratio of the bainite structure is 85% or more, the evaluation of XF is made in the case of the mixture of the bainite structure and the ferrite structure (the area ratio of the ferrite structure is 15% or more), and the results are shown in Table 2.

In the table, the area ratio of bainite actually measured in parentheses is also shown in addition to the evaluation of O and X.

<Internal Pressure Fatigue Strength>

Next, the hot forged material is provided with the main hole 12 and the small holes 20*a* to 20*e* by cutting (refer to FIGS. 1A and 1B), and a test piece for the internal pressure fatigue test is produced, and after the hot forged material has been heated at a temperatures shown in Table 2 for 1 hour and subjected to the aging treatment, the internal pressure fatigue test is performed. A pressure generating source is connected to the small holes 20*a* of the test piece, and a pressure sensor is provided in the middle of the connection. After the end portions of the other small holes 20*b* to 20*e* and both ends of the main hole 12 have been sealed, oil is allowed to flow from the small hole 20*a* connected to the pressure generating source so as to periodically change a stress, and the fatigue strength by the internal pressure repetition rate is compared and evaluated, and the results are shown in Table 2.

In Table 2, a case where the fatigue strength is higher than that of a test piece of the non-heat treated steel of the ferrite-pearlite type which has been subjected to the similar test is designated as "O" and a case where the fatigue strength is lower than that of the test piece of the non-heat treated steel of the ferrite-pearlite type is designated as "X".

<Burst Fracture Strength>

The main hole 12 and the small holes 20*a* to 20*e* are provided in the hot forged material by cutting (refer to FIGS. 1A and 1B), test pieces for burst fracture strength test are produced, and the test pieces are subjected to the aging treatment by heating at the temperatures shown in Table 2 for 1 hour, and then subjected to the burst fracture strength test. A pressure generating source is connected to the small holes 20*a* of the test piece, and a pressure sensor is provided in the middle of the connection. After the end portions of the other small holes 20*b* to 20*e* and both ends of the main hole 12 have been sealed, oil is allowed to flow from the small hole 20*a* connected to the pressure generating source so as to change the stress temporarily incrementally, and the burst fracture strength due to the static internal pressure is compared and evaluated, and the results are shown in Table 2.

The test pressure is set to 300 MPa or more, and in Table 2, a case where the burst fracture strength is higher than that of the test piece of the non-heat treated steel of the ferrite pearlite type which has been subjected to the similar test is designated as "O" and a case where the burst fracture strength is lower than that of the test piece of the non-heat treated steel of the ferrite pearlite type is designated as In the results of Table 2, in Comparative Example 1, the forging heating temperature is lower than 950° C., which is a lower limit value of the present disclosure, and the steel structure is a mixed structure with ferrite. As a result, the hardness after the aging treatment is lower than that of the examples, and both the results of the internal pressure fatigue strength and the burst fracture strength are "X".

In Comparative Example 2, the average cooling rate (first average cooling rate) of 800° C. to 500° C. is lower than 0.1° C./sec, which is a lower limit value of the present disclosure, and the steel structure is a mixed structure with ferrite. Also in Comparative Example 2, the hardness after the aging treatment is lower than that in the examples, and both the results of the internal pressure fatigue strength and the burst fracture strength are "X".

Comparative Example 3 is an example in which the average cooling rate of 500° C. to 300° C. (second average cooling rate) is lower than the lower limit value of 0.02° C./sec. of the present disclosure. In Comparative Example 3, the steel structure is a bainite single phase structure, and the hardness after aging treatment is obtained to the same extent as in examples, but both the results of the internal pressure fatigue strength and the burst fracture strength are "X". It is presumed that this is because the cementite precipitated in the bainite structure becomes coarse due to the low second average cooling rate.

On the other hand, in Examples 1 to 21 satisfying the conditions of the present disclosure, the evaluation of both the internal pressure fatigue strength and the burst fracture strength is "0", and the excellent results are obtained. In other words, the fuel injection component to which a high internal pressure is repeatedly applied is manufactured with the use of the steel material having the composition of the present disclosure under the manufacturing conditions described above, the higher withstand pressure strength can be ensured, and brittle fracture, which instantaneously ruptures when an operating maximum pressure or an abnormal high pressure is applied, can be avoided. In particular, the toughness at a low temperature can be improved.

In Example 20, the hardness of the hot forging is increased and the aging treatment is omitted. Example 21 is an example in which the autofrettaging process (AF processing) is performed after machining. Excellent results are obtained for those Examples 20 and 21 in the same manner as in the other examples.

The foregoing detailed description of the embodiments and examples of the present disclosure has been presented by way of example only. Although the common rail is exemplified in the above embodiments and examples, the present disclosure can be implemented in various modifications without departing from the spirit thereof, such as being applicable to other fuel injection components.

What is claimed is:

1. A method for manufacturing a fuel injection component by processing a workpiece into a predetermined shape, wherein the workpiece is made of a steel having compositions, by mass %, of C: 0.08 to 0.16%,
Si: 0.10 to 0.30%,
Mn: 1.00 to 2.00%,
S: 0.005 to 0.030%,
Cu: 0.01 to 0.30%,
Ni: 0.40 to 1.50%,
Cr: 0.50 to 1.50%,
Mo: 0.30 to 0.70%,
V: 0.10 to 0.40%,
s-Al: 0.001 to 0.100%, and
Fe and unavoidable impurities as remaining components, the method comprising:

subjecting the workpiece to hot forging after heating the workpiece to a temperature of 950° C. or more and 1350° C. or less;

first cooling the workpiece, after the hot forging, at an average cooling rate of 0.1° C./sec. or more in a temperature range from 800° C. to 500° C.; and second cooling the workpiece, after the first cooling, at an average cooling rate of 0.02° C./sec. or more and 10° C./sec. or less in a subsequent temperature range from 500° C. to 300° C. to set an area ratio of a bainite structure after hot forging to 85% or more.

2. The method according to claim 1, wherein the steel further contains one or two of Ti:≤0.100% and Nb:≤0.100% by mass %.

3. The method according to claim 1, wherein a maximum diameter $\sqrt{area_{max}}$ of non-metallic inclusions estimated by an extreme value statistical method in the workpiece after the hot forging is 300 μm or less.

4. The method according to claim 1, further comprising:

performing, after the hot forging, an aging treatment in a temperature range of 550° C. to 700° C.

5. The method according to claim 1, further comprising:

performing an autofrettaging process on the workpiece in which a fuel flow channel is formed.

6. The method according to claim 1, further comprising: performing machining on the workpiece.

7. The method according to claim 1, further comprising: performing machining on the workpiece to from a fuel flow channel in the workpiece; and performing an autofrettaging process on fuel flow channel of the workpiece.

* * * * *